United States Patent [19]

Ganon

[11] Patent Number: 4,620,495

[45] Date of Patent: Nov. 4, 1986

[54] MACHINE AND METHOD FOR STITCHING A SLIPPER UPPER TO AN OUTSOLE

[75] Inventor: Michael H. Ganon, Bexley, Ohio

[73] Assignee: R. G. Barry Corporation, Columbus, Ohio

[21] Appl. No.: 826,590

[22] Filed: Feb. 6, 1986

[51] Int. Cl.[4] ..... D05B 15/08; D05B 27/04; D05B 29/04

[52] U.S. Cl. ..... 112/262.1; 112/60; 112/62; 112/235; 112/320; 12/142 T; 36/12

[58] Field of Search ..... 112/60, 62, 320, 36, 112/32, 262.1, 235, 321; 12/13.2, 9.1, 142 C, 142 D, 142 T; 36/12, 14

[56] References Cited

U.S. PATENT DOCUMENTS

| | | | |
|---|---|---|---|
| 2,610,597 | 9/1952 | Simmons | 112/62 |
| 3,291,085 | 12/1966 | Levy | 112/262.1 |
| 3,821,827 | 7/1974 | Nadler | 12/142 C |
| 4,388,880 | 6/1983 | Ciucani | 112/49 |

OTHER PUBLICATIONS

Adler, 69 FA 73/E.O.S., "Stitching Machine".

*Primary Examiner*—Werner H. Schroeder
*Assistant Examiner*—Andrew M. Falik
*Attorney, Agent, or Firm*—Watson, Cole, Grindle & Watson

[57] ABSTRACT

A fabric slipper upper is stitched on a stitching machine along the inner surface of a peripheral flange of an outsole by the provision of an upper feed only and a nosepiece having a blunted end and smooth sides and ends but with no lower feed.

4 Claims, 11 Drawing Figures

MACHINE AND METHOD FOR STITCHING A SLIPPER UPPER TO AN OUTSOLE

BACKGROUND OF THE INVENTION

This invention relates generally to a machine and a method for stitching together a relatively soft fabric upper (sometimes referred to as a vamp) to an outsole, which may be of a synthetic rubber material, for the production of footwear, such as slippers.

In the production of slippers, it has been customary to stitch together the peripheral ends of the upper or vamp and the outsole in face-to-face relationship. In one of such slipper constructions, a welt is first stitched about the outer periphery of the fabric upper after which the welted periphery is externally stitched along the periphery of a flat outsole. Such a construction is quite satisfactory in that it presents a neat construction which can be easily and efficiently produced, and assures adequate toe space above the toe of the wearer, although the external welt may not be preferred by the customer.

Another approach taken in the production of slippers is to stitch the fabric upper along its periphery to a peripheral flange of the outsole while both the upper and the outsole are turned inside out. After stitching, the upper is manually turned right side out so as to expose the outer surfaces of the upper and the outsole. Although such construction is quite satisfactory, it nevertheless is limited in that the toe space is constrained, similar to that of ballerina type footwear.

It would therefore be desirable to produce a slipper by stitching a peripherally flanged outsole externally around the bottom periphery of the vamp or upper so as to both avoid the need for a welt while at the same time providing for ample toe clearance. However, existing machines and techniques are generally ineffective for such a slipper construction because of the difficulty in extending the lower stitching elements of the machine far enough under the front toe portion for effective stitching while at the same time avoiding a bunching of the soft fabric upper during the stitching operation.

SUMMARY OF THE INVENTION

It is therefore an object of the present invention to provide an improved machine and technique for the stitching of a soft fabric upper to a flanged outsole of synthetic rubber material rapidly, efficiently, economically and neatly without any bunching of the fabric during stitching. The stitching machine according to the invention has a shuttle carrying a bobbin of under thread mounted on a lower transversely extending arm of the machine, and a nosepiece mounted on the lower arm over the bobbin. An outer presser foot is mounted on a transversely extending upper arm of the machine for vertical reciprocation. An inner feeder foot is mounted on this upper arm for reciprocation in the stitching direction, and an eye-pointed needle carrying an upper thread is mounted on the upper arm and extends through an opening in the feeder foot. The nosepiece has a blunted upper end containing an elongated slot through which the needle extends for interengaging the upper and lower threads, there being no lower feed mechanism on the lower arm which would otherwise be exposed through the nosepiece slot for cooperation with the feeder foot such that the feeder foot functions to solely advance the slipper during stitching. And, the nosepiece has smooth and rounded end and side walls extending from the blunted upper end, these walls being rather steep, and the nosepiece extending upwardly from the lower support arm and into the slipper upper an adequate distance to facilitate stitching the vamp to the peripheral flange of the outsole from the outer surface of the flange.

Moreover, the presser foot has an angular undersurface defined by a downwardly extending lip along the outer side thereof, such undersurface being adapted for bearing, during stitching, against the external corner of the outsole defined along the peripheral flange thereof. And, the inner feeder foot may have a gripping surface confronting the nosepiece.

The method according to the invention, for stitching a fabric slipper upper to an outsole having a peripheral flange, employs a stitching machine having generally the aforedescribed features.

Other objects, advantages and novel features of the invention will become more apparent from the following detailed description of the invention when taken in conjunction with the accompanying drawings.

BRIEF DESCRIPTION OF THE DRAWINGS

FIG. 1 is a view similar to FIG. 9 showing the lapped outsole flange and underlying peripheral end of the upper clamped between the presser foot and the nosepiece during the stitching operation.

DETAILED DESCRIPTION OF THE INVENTION

Figure 1:
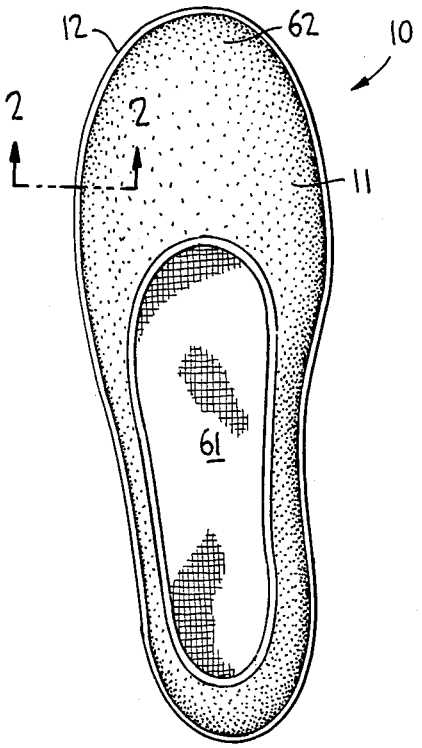
FIG. 1 is a top plan view of a slipper constructed according to the invention.
Figure 2:
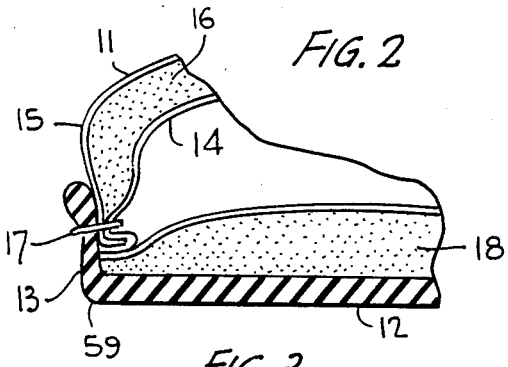
FIG. 2 is a cross-sectional view taken substantially along the line 2—2 of FIG. 1.

Turning now to the drawings wherein like reference characters refer to like and corresponding parts throughout the several views, the slipper produced according to the invention, generally designated 10 in FIG. 1, has a soft fabric upper or vamp 11 stitched along its lower periphery to an outsole 12 which may be of synthetic rubber material such as polyvinylchloride or thermoplastic rubber compound. As more clearly shown in FIG. 2, the outsole has an upstanding flange 13 extending about the entire periphery, and vamp 11 may comprise a composite of inner and outer soft fabric layers 14 and 15 having a layer 16 of some suitable type of foam or cushion material therebetween. The vamp is stitched directly to flange 13 as at 17 in a manner to be described in detail hereinafter, and a cushion insole 18 may be conveniently stitched in place to the vamp in a manner forming no part of the invention.

Figure 3:
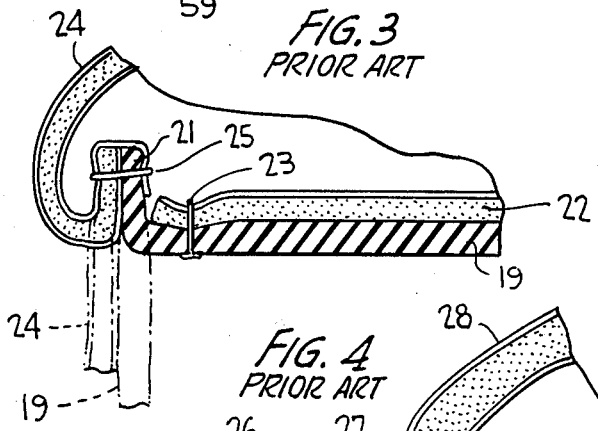
FIG. 3 PRIOR ART
FIGS. 3 and 4 are cross-sectional views of prior art slipper constructions.

The prior art slipper construction of FIG. 3 has an outsole 19 with a peripheral flange 21, an insole 22 stitched as at 23 to the outsole, and a vamp or upper 24 stitched as at 25 to the flange. Typically, the vamp is turned inside out before stitching at 25, and the outsole is bent at its flange so as to lie somewhat parallel to the vamp during stitching, as shown in phantom outline in FIG. 3. The vamp and outsole are thus stitched together along their peripheries substantially in face-to-face relationship using a standard commercial stitching machine. Thereafter, the vamp is turned inside in after completing the stitching at 25 so as to appropriately revert the vamp and outsole to the solid outline condition of FIG. 3. Although satisfactory results are achieved, it has been found that the toe portion of the shoe is somewhat flat and tight with insufficient top toe clearance for many wearers.

Figure 4:
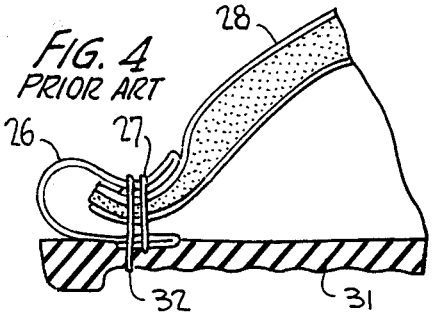
FIG. 4 PRIOR ART

In the FIG. 4 prior art construction, an overlapped strip forming a welt 26 is stitched as at 27 along the peripheral edge of vamp 28, after which the welt and vamp are stitched along the peripheral edge of a flat outsole 31 as at 32. Again, the vamp and outsole are stitched together along their peripheral edges in substantially face-to-face relationship, although welt 26 remains exposed which may be unpreferable.

Figure 5:
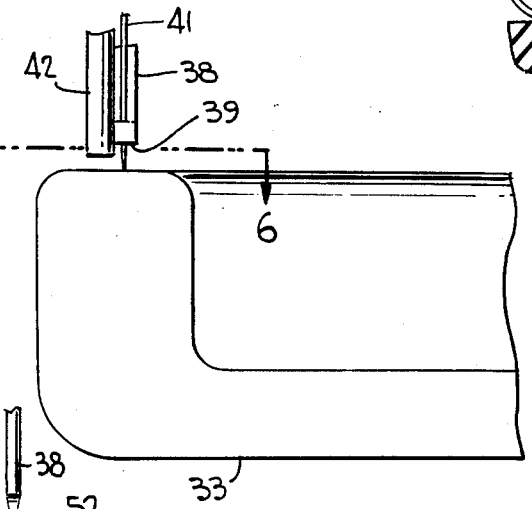
FIG. 5 PRIOR ART
FIG. 5 is a side view of a portion of a prior art machine which may be employed for the construction of slippers according to FIGS. 3 and 4.
Figure 6:
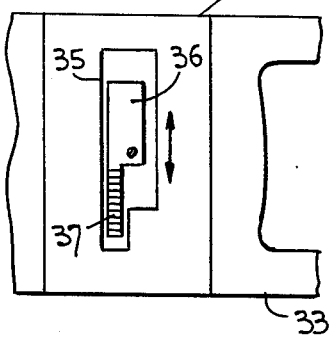
FIG. 6 PRIOR ART
FIG. 6 is a plan view taken along the line 6—6 of FIG. 5.

A portion of a prior art stitching machine is shown in FIGS. 5 and 6 which may be employed for constructing slippers according to FIGS. 3 and 4. Such may comprise a post machine having a lower transversely extending support arm 33 which contains within its free end a shuttle carrying a bobbin of under thread (not shown), and a cover plate 34 over the bobbin having an elongated opening 35 through which a standard lower feed plate 36 is exposed for reciprocation in the direction of the arrow of FIG. 6 between forward and rearward ends of the slots. This feed mechanism typically has a gripping surface 37 in the form of serrations or the like, and plate 36 is reciprocated by suitable mechanism (not shown) contained within an upper portion of arm 33.

The lower feed plate typically cooperates with an inner feeder foot 38 having a gripper surface at its lower end 39 and being mounted on an upper arm (not shown) of the machine for reciprocation for advancing the material during stitching, upon cooperation with lower feed 36. An eye-pointed needle 41 is likewise mounted on the upper support arm for reciprocation and extends through a slot in the feeder foot for interengaging the upper and lower threads, as in a well-known manner. And, an outer presser foot 42 is mounted on the upper arm for clamping down on the material to be stitched, as in any typical manner.

Figure 7:
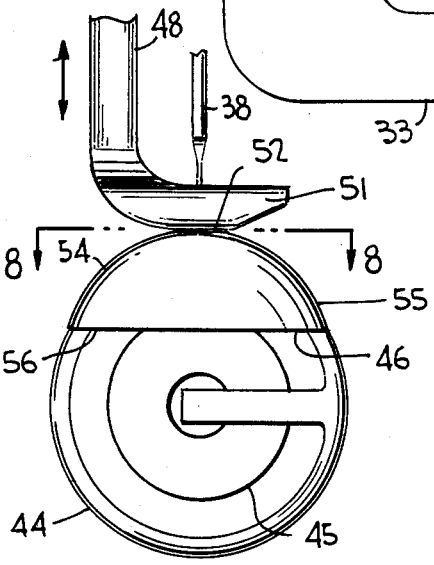
FIG. 7 is an end view of a portion of the modified stitching machine according to the invention showing the nosepiece and outer presser foot in side elevation.
Figure 9:
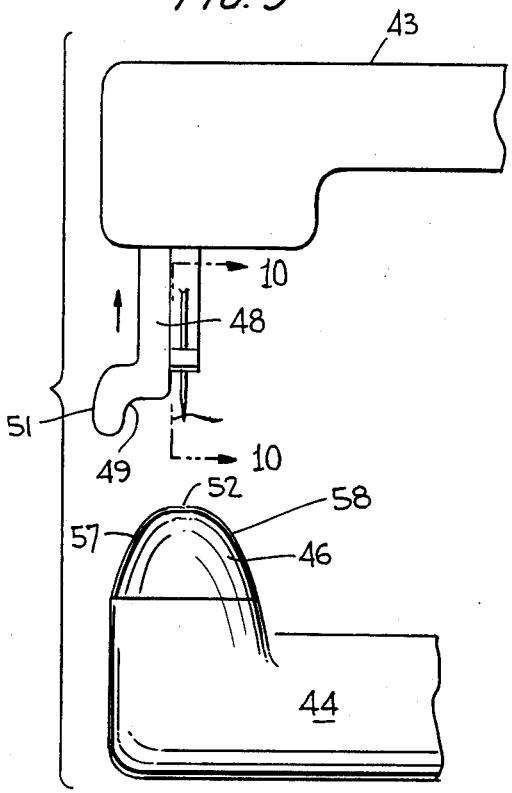
FIG. 9 is a side elevational view of a portion of the stitching machine according to the invention.
Figure 10:
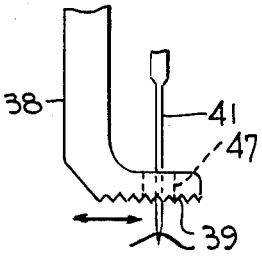
FIG. 10 is a view taken substantially along the line 10—10 of FIG. 9 showing a portion of the inner feeder foot.

In accordance with the invention, the essential parts of the machine according to the invention are shown in FIG. 9 as including an upper transversely extending support arm 43 and a lower transversely extending support arm 44, a shuttle carrying a bobbin 45 (shown in FIG. 7 with the end plate removed) being mounted in the lower arm adjacent its free end, as in a typical manner. A nosepiece 46, in the form of an inverted cup, is mounted on the lower arm over the bobbin. Inner feeder foot 38 is mounted on the upper arm, and needle 41 is likewise mounted on the upper arm and extends through a suitable slot 47 of the feeder foot (FIG. 10). An outer presser foot 48 is mounted on the upper arm for reciprocation in the direction of the double arrow of FIG. 7, and has an angular undersurface 49 (FIG. 9) defined by a depending lip 51 at the outer end of the foot.

Figure 8:
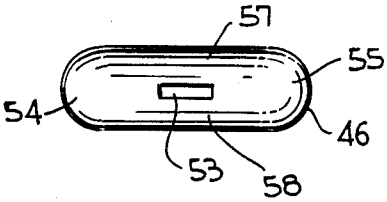
FIG. 8 is a top plan view of the nosepiece taken substantially along the line 8—8 of FIG. 7.

The nosepiece has a blunted flat upper end 52 containing an elongated slot 53 (FIG. 8) through which needle 41 extends for interengaging the upper and lower threads in a typical manner. Slot 53 may be of such a narrow width as to just slightly exceed the thickness of needle 41. And, the slot 53 has a relatively short length sufficient to only accommodate the short fore and aft travel of reciprocating needle 41. Thus, since no bottom feed plate such as 36 is required or intended for the present machine, slot 53 may be much smaller in width and length compared to slot 35 of the FIG. 6 prior art machine.

End walls 54 and 55 (FIGS. 7 and 8) comprise smoothly rounded surfaces extending between blunt end 52 and a lower peripheral edge 56 of the cup-shaped nosepiece. Similarly, sidewalls 57 and 58, (FIGS. 8, 9) comprise smooth and rounded surfaces extending between blunt end 52 and lower edge 56 of the nosepiece. The side and end surfaces of the nosepiece are therefore rounded smooth contours, and the nosepiece extends upwardly of support arm 44 on which it is mounted. The end walls and side walls of the nosepiece are thus less steep since no lower feed, which would otherwise be exposed through the slot, is required or intended.

Figure 11:
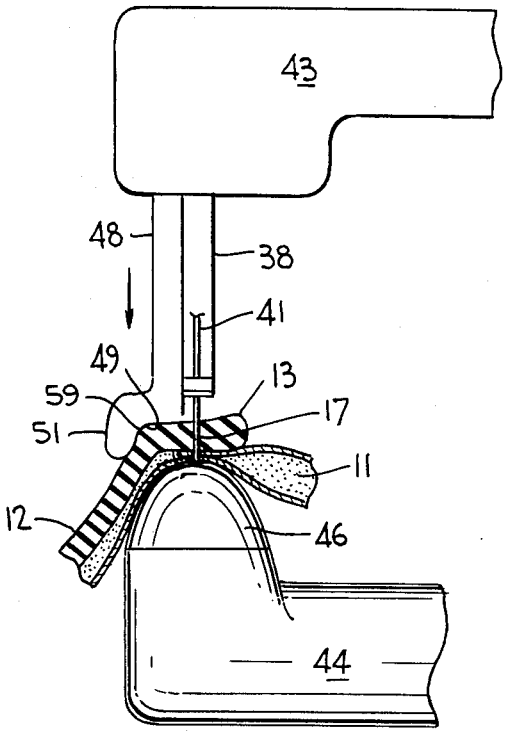

In operation, the presser foot, and the feeder foot are elevated from the nosepiece (as in FIG. 9) by a suitable lever mechanism, as in any normal manner, and a lapped joint comprising flange 13 of the outsole overlapping the peripheral end of the vamp are inserted between the presser foot and the nosepiece, after which the presser foot and the feeder foot are manually lowered by the lever mechanism (not shown) into the FIG. 11 position such that this lapped joint is clamped against the nosepiece. Stitching at 17 may now proceed so as to stitch the overlapped parts together as the lapped joint is advanced in a stitching direction solely by the reciprocating feeder foot 38. Angular undersurface 49 of the presser foot bears along external corner 59 formed between flange 13 and the flat bottom side of the outsole, as shown in FIG. 11, so as to thereby effectively guide the lapped joint during the stitching operation. Stitching proceeds until the slipper 10 is completed.

It can be therefore seen that by providing a slender and rather pointed and smoothly contoured nosepiece, without any reliance on a lower feed, the nosepiece may conveniently extend during the stitching operation through vamp opening 61 and into to the end of toe portion 62 (FIG. 1) for conveniently and rapidly providing for the stitching of the outsole flange externally to the underlying peripheral edge of the vamp but without any bunching or fabric gathering whatsoever. The feeder foot solely effects advance of the material being stitched with little or no assist by the operator, and angular undersurface 49 serves as a convenient guide maintaining the overlapped ends of FIG. 11 in the appropriate transverse position for stitching as this undersurface bears against the external corner of the outsole.

Obviously, many modifications and variations of the present invention are made possible in the light of the above teachings. It is therefore to be understood that within the scope of the appended claims the invention may be practiced otherwise than as specifically described.

What is claimed is:

1. A machine for stitching a fabric slipper upper to an outsole, said outsole having a peripheral flange, the machine comprising upper and lower transversely extending support arms, a shuttle carrying a bobbin under thread mounted on said lower arm, a nosepiece mounted on said lower arm over said bobbin, an outer presser foot mounted on said upper arm for reciprocation in a vertical direction, an inner feeder foot mounted on said upper arm for reciprocation in a stitching direction perpendicular to said vertical direction, an eye-pointed needle carrying an upper thread mounted on said upper arm and extending through an opening in said feeder foot, said nosepiece having a blunted upper end containing an elongated slot through which said needle extends, there being no lower feed mechanism on said lower arm for cooperation with said feeder foot such that said feeder foot solely advances the slipper during stitching, said nosepiece having smooth and rounded end and side walls extending from said blunted upper end thereof, and said nosepiece extending upwardly of said lower arm and extendable into the slipper to facilitate stitching to the peripheral flange from the outer surface thereof.

2. The machine according to claim 1, wherein said presser foot has an angular undersurface defined by a downwardly extending lip along the outer side thereof, said angular undersurface being adapted for bearing against an external corner of the outsole along the peripheral flange thereof during stitching.

3. The machine according to claim 1, wherein said inner feeder foot has a gripping surface confronting said nosepiece.

4. A method of stitching a fabric slipper upper to an outsole having a peripheral flange by employing a stitching machine having transversely extending upper and lower support arms, a shuttle carrying a bobbin of under thread mounted on said lower arm, and an outer presser foot, an inner feeder foot and an eye-pointed needle carrying an upper thread mounted in said upper arm, comprising the steps of providing a blunted and slender nosepiece on said lower support arm over said bobbin, lapping said peripheral flange over a peripheral end of said upper to form a lapped joint, supporting the lapped joint against said nosepiece at a blunted end thereof, clamping the lapped joint against said blunted end by said presser foot, advancing the lapped joint for stitching said lapped peripheral flange and end together by solely reciprocating said feeder foot, providing an elongated slot in said blunted end through which said needle extends during stitching, and guiding the lapped joint during stitching by engaging said presser foot about an external corner of said outsole at said peripheral flange thereof.

* * * * *